US007564001B2

(12) United States Patent
Koizumi

(10) Patent No.: US 7,564,001 B2
(45) Date of Patent: Jul. 21, 2009

(54) SWITCH AND REMOTE CONTROLLER USING THE SAME

(75) Inventor: Shuichi Koizumi, Fukui (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 11/949,889

(22) Filed: Dec. 4, 2007

(65) Prior Publication Data

US 2008/0128256 A1 Jun. 5, 2008

(30) Foreign Application Priority Data

Dec. 4, 2006 (JP) ..... 2006-326601
Dec. 4, 2006 (JP) ..... 2006-326602

(51) Int. Cl.
*H01H 13/14* (2006.01)

(52) U.S. Cl. ..... 200/341; 200/293; 70/395

(58) Field of Classification Search ..... 200/341, 200/293–296, 302.2; 70/395–399, 403, 405, 70/408

See application file for complete search history.

(56) References Cited

U.S. PATENT DOCUMENTS 6,437,267 B1 * 8/2002 Imai ..... 200/302.1
6,501,036 B2 * 12/2002 Rochon et al. ..... 200/302.2
7,050,292 B2 * 5/2006 Shimura et al. ..... 361/679
2002/0056627 A1 * 5/2002 Rochon et al. ..... 200/302.2
2004/0200709 A1 * 10/2004 Sugimoto et al. ..... 200/302.2

FOREIGN PATENT DOCUMENTS

JP 2006-164871 6/2006

* cited by examiner

*Primary Examiner*—Kyung Lee
(74) *Attorney, Agent, or Firm*—Wenderoth, Lind & Ponack, L.L.P.

(57) ABSTRACT

A switch includes a case having an upper surface with a hole provided therein, an operating unit inserted in the hole so as to be movable up and down, plural switch contacts arranged to be activated upon the operating unit moving up and down, and a guide wall protruding downward from an inner edge of the hole. The operating unit has a side surface facing the guide wall. The guide wall has a cutout provided therein. This switch operates reliably with a good operational feel.

15 Claims, 5 Drawing Sheets

Fig. 8 - PRIOR ART
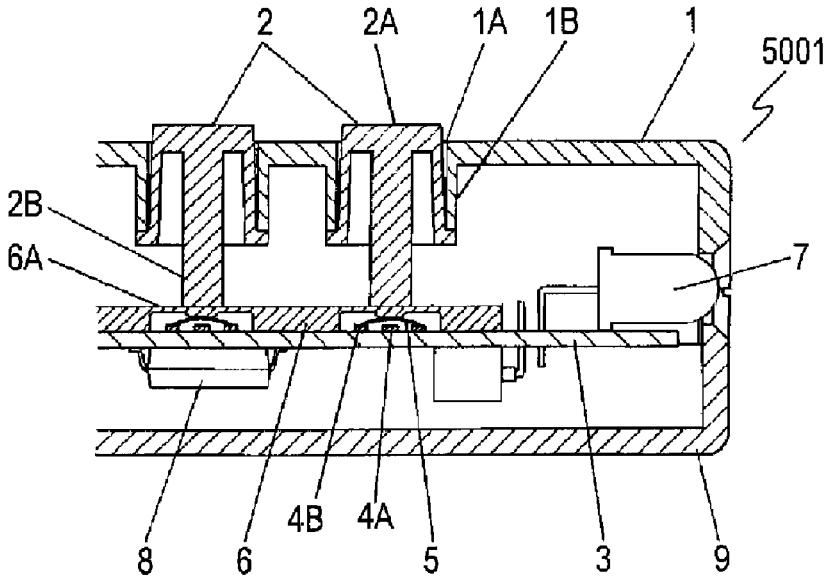
Fig. 9 - PRIOR ART
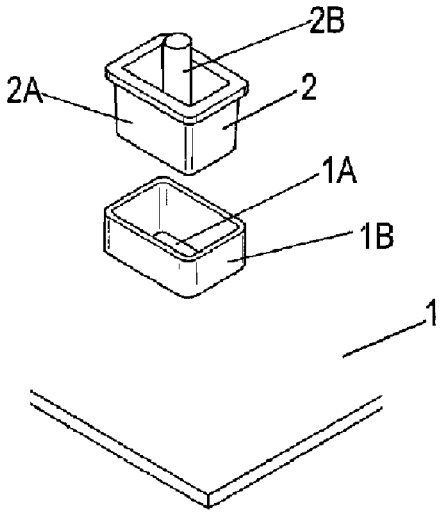

SWITCH AND REMOTE CONTROLLER USING THE SAME

FIELD OF THE INVENTION

The present invention relates to a switch and a remote controller using the switch.

BACKGROUND OF THE INVENTION

Electronic apparatuses in the fields of video, audio and air-conditioning have recently had various high-end functions, so that switches and remote controllers that operate these apparatuses are required to operate reliably with a good operational feel.

FIGS. 8 and 9 are a sectional view and an exploded perspective view of conventional remote controller 5001, respectively. Case 1 has substantially a box shape and is made of insulating resin. Operating unit 2 is made of insulating resin. Plural holes 1A are formed in a top surface of case 1. Operating unit 2 is inserted movably up and down in each of holes 1A, and includes operating section 2A projecting upward from hole 1A.

Guide wall 1B having a squared tubular shape protrudes downward from an inner edge of hole 1A. Operating unit 2 includes depressing section 2B protruding downward from a lower surface thereof. Guide wall 1B is spaced apart by a small gap from a side surface of operating unit 2.

Plural wiring patterns are provided on an upper surface and a lower surface of wiring board 3. Fixed contacts 4A and 4B made of conductive material, such as carbon, are provided on the upper surface of wiring board 3. Movable contact 5 which is made of conductive metal plate and which has a substantially dome shape is placed on fixed contact 4B. Movable contact 5 faces fixed contact 4B with a predetermined gap between contacts 4B and 5.

Elastic sheet 6 made of elastic insulator, such as rubber, is provided on the upper surface of wiring board 3. Elastic sheet 6 has thinner portion 6A over movable contact 5. A projection is provided on a lower surface of thin portion 6A, thus providing a switch.

Transmitting section 7 and control section 8 are provided on the upper surface and the lower surface of wiring board 3. Transmitting section 7 includes an electronic component, such as a light emitting diode, for transmitting a remote controlling signal. Control section 8 includes a semiconductor device, such as a microprocessor, and is coupled to transmitting section 7 and fixed contacts 4A and 4B via the wiring patterns.

Cover 9 which has a box shape and which is made of insulating resin covers a lower surface of case 1 accommodating operating unit 2 and wiring board 3 therein. Cover 9 is fixed to case 1 with fixing members, such as screws, thus providing remote controller 5001.

Remote controller 5001 is directed toward an electronic apparatus, such as a television receiver or a radio receiver, and operating section 2A of operating unit 2 is configured to be depressed. When operating section 2A is depressed, depressing section 2B depresses movable contact 5 via thin portion 6A of elastic sheet 6. Movable contact 5 accordingly deforms elastically so as to turn inside out and contact fixed contact 4A, thereby electrically connecting fixed contact 4A to fixed contact 4B. Upon fixed contact 4A being connected electrically to fixed contact 4B, control section 8 allows transmitting section 7 to transmit an infrared remote controlling signal to the electronic apparatus in order to remotely control the electronic apparatus, for example, to turn on and off the apparatus, to select a channel, and to increase and decrease sound volume.

Guide wall 1B provided at the inner edge of hole 1A is spaced by a small clearance from the side surface of operating unit 2. Guide wall 1 allows operating unit 2 to be depressed while operating unit 2 slants little or wobbles little. That is, the entire inner wall of guide wall 1B has a length substantially identical to that of the side surface of operating unit 2A, and guides the entire side surface of operating unit 2 so as to prevent operating unit 2 from slanting and wobbling during the operation of operating unit 2. This prevents operating unit 2 from sinking in case 1 even when receiving a large force, thereby allowing the operating unit to be pressed reliably.

In conventional remote controller 5001, operating unit 2 is guided by guide wall 1B surrounding operating unit 2 across the small gap and having a large length. When a liquid or drink, such as coffee or juice, is spilled onto to the upper surface of operating unit 2 or case 1, the liquid may flow through hole 1A, then dry and clot in the small gap. In this case, the clot prevents operating unit 2 from moving up and down, decreases the good feeling, and prevents operating unit 2 from moving smoothly, thus preventing remote controller 5001 from operating.

SUMMARY OF THE INVENTION

A switch includes a case having an upper surface with a hole provided therein, an operating unit inserted in the hole so as to be movable up and down, plural switch contacts arranged to be activated upon the operating unit moving up and down, and a guide wall protruding downward from an inner edge of the hole. The operating unit has a side surface facing the guide wall. The guide wall has a cutout provided therein.

This switch operates reliably with a good operational feel.

BRIEF DESCRIPTION OF THE DRAWINGS

FIG. 8 is a sectional view of a conventional remote controller.

FIG. 9 is an exploded perspective view of an essential part of the remote controller shown in FIG. 8.

DETAILED DESCRIPTION OF THE PREFERRED EMBODIMENTS

Exemplary Embodiment 1

Figure 1:
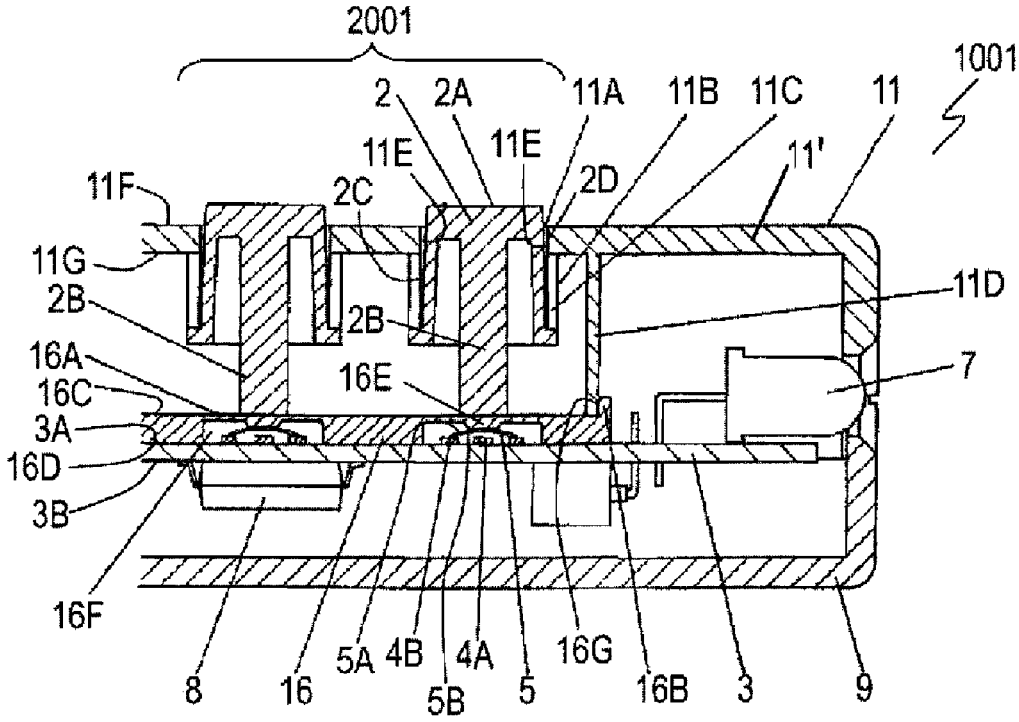
FIG. 1 is a sectional view of a remote controller in accordance with Exemplary Embodiment 1 of the present invention.
Figure 2:
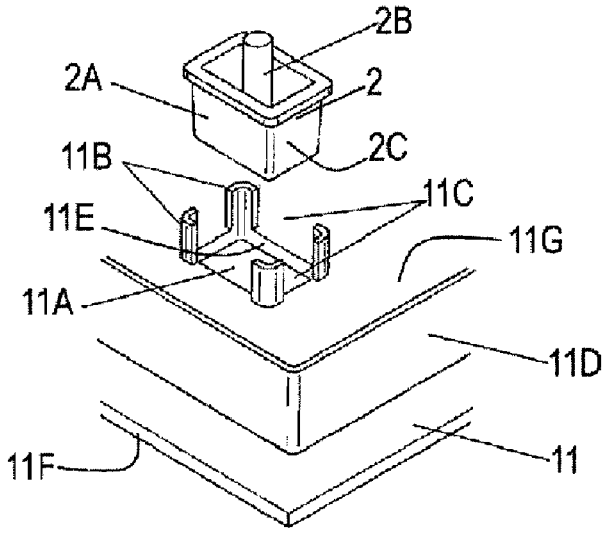
FIG. 2 is an exploded perspective view of an essential part of the remote controller shown in FIG. 1.

FIGS. 1 and 2 are a sectional view and an exploded perspective view of an essential part of remote controller 1001 in accordance with Exemplary Embodiment 1 of the present invention, respectively. Case 11 has a box shape and is made of insulating resin, such as ABS resin or polystyrene. Operating unit 2 is made of insulating resin. Case 11 has a case wall 11' with upper surface 11F and lower surface 11G opposite to upper surface 11F. Holes 11A each having inner edge 11E are formed in upper surface 11F. An operating unit 2 is inserted in each hole 11A so as to be movable up and down, and includes operating section 2A protruding from upper surface 11F. Side surface 2C of operating unit 2 faces inner edge 11E of hole 11A.

Guide wall 11B having a substantially squared tubular shape protrudes from lower surface 11G of case 11 at inner edge 11E of hole 11A. Guide wall 11B is distanced from side surface 2C of operating unit 2 by a small gap 2D. Guide wall 11B has cutouts 11C in respective surfaces thereof. Cutouts 11C extend to lower surface 11G of case 11. Operating unit 2 includes depressing section 2B protruding downward in case 11.

Wiring board 3 is made of insulating material, such as paper phenol or glass epoxy, and includes upper surface 3A and lower surface 3B opposite to upper surface 3A. Wiring patterns made of conductive material, such as copper foil, are provided on upper surface 3A and lower surface 3B. Fixed contacts 4A and 4B made of conductive material, such as copper foil or carbon, are provided on upper surface 3A.

Movable contact 5 has a dome shape having convex surface 5A and concave surface 5B opposite to the convex surface. Movable contact 5 is made of plate of conductive metal, such as copper alloy. An outer periphery of movable contact 5 is placed on fixed contact 4A. Concave surface 5B of movable contact 5 faces fixed contact 4A across a predetermined gap, thus providing plural switch contacts.

Elastic sheet 16 made of elastic insulating material, such as rubber or elastomer, is placed on upper surface 3A of wiring board 3. Elastic sheet 16 has upper surface 16C and lower surface 16D opposite to upper surface 16C. Lower surface 16D is situated on upper surface 3A of wiring board 3. Recess 16F provided in lower surface 16D accommodates movable contact 5 therein. Elastic sheet 16 has thin portion 16A situated at a bottom of recess 16F, projection 16E protruding downward from thin portion 16A toward movable contact 5, and rib 16B provided at an outer periphery of sheet 16. Case 11 has water-sealing wall 11D protruding downward from lower surface 11G. Wall 11D elastically contacts inner wall 16G of rib 16B, thus providing switch 2001.

Transmitting section 7 and control section 8 are provided on upper surface 3A and lower surface 3B of wiring board 3. Transmitting section 7 includes an electronic component, such as light emitting diode, for transmitting a remote controlling signal. Control section 8 includes a semiconductor device, such as a microprocessor, and is coupled to transmitting section 7 and fixed contacts 4A and 4B via the wiring patterns.

Cover 9 which has a box shape and which is made of insulating resin covers a lower surface of case 11 accommodating operating unit 12 and wiring board 3 therein. Cover 9 is fixed to case 11 with fixing members, such as screws, thus providing remote controller 1001.

An operation of remote controller 1001 will be described below. Remote controller 1001 is directed toward an electronic apparatus, such as a television receiver or a radio receiver, and operating section 2A of operating unit 2 is depressed. Upon being depressed, depressing section 2B depresses movable contact 5 via thin portion section 16A of elastic sheet 16. This causes movable contact 5 to elastically deform and turn inside out, allows concave surface 5B to contact fixed contact 4A, and then, connects fixed contact 4A electrically with fixed contact 4B, thus activating the switch contacts. Upon the switch contacts being activated, that is, upon fixed contacts 4A and 4B being connected electrically with each other, control section 8 allows transmitting section 7 to transmit an infrared remote controlling signal to the electronic apparatus in order to remotely control the electronic apparatus, for example, to turn on and off the apparatus, to select a channel, and to increase and decrease sound volume.

Guide wall 11B faces side surface 2C of operating unit 2 with small gap 2D therebetween, which allows depressing of operating unit 2 while preventing unit 2 from slanting and wobbling. That is, guide wall 11B guides four corners of operating unit 2, thereby preventing operating unit 2 from slanting and wobbling while operating unit 2 is depressed. This prevents operating unit 2 from sinking in case 11 even if a large force is applied to operating unit 2, thus allowing operating unit 2 to be depressed reliably.

Cutouts 11C are formed in four surfaces of guide wall 11B. Even if liquid or water, such as coffee or juice, is spilled onto upper surface 11F of case 11 and flows through hole 11A, operating unit 2 can still be activated easily. That is, when the liquid flows into hole 11A, the liquid immediately flows out from cutout 11C into a space between sheet 16 and upper surface 11G, thus being prevented from remaining and clotting in gap 2D. Therefore, switch 2001 is activated easily and reliably without losing a good operational feel, thus activating the switch contacts reliably.

Elastic sheet 16 covers upper surface 3A of wiring board 3. Water-sealing wall 11D protruding downward from lower surface 11G of case 11 elastically contacts inner wall 16G of rib 16B provided at an outer periphery of sheet 16, thereby providing a waterproof structure. This structure prevents the liquid flowing out from cutout 11C from reaching wiring board 3, fixed contacts 4A and 4B, and movable contact 5, thus activating the switch contacts reliably.

Figure 3:
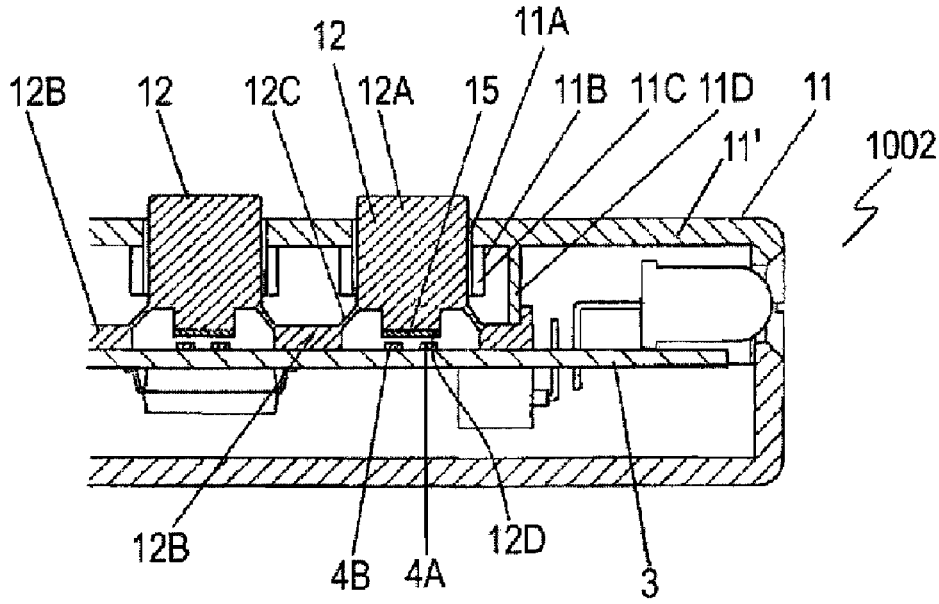
FIG. 3 is a sectional view of another remote controller in accordance with Embodiment 1.

FIG. 3 is a sectional view of another remote controller 1002 in accordance with Embodiment 1. In FIG. 3, components identical to those of remote controller 1001 shown in FIG. 1 are denoted by the same reference numerals, and their descriptions will be omitted. Remote controller 1002 shown in FIG. 3 includes elastic sheet 12 instead of operating unit 2 and elastic sheet 16 of remote controller 1001 shown in FIG. 1, and includes movable contact 15 instead of movable contact 5 of remote controller 1001. Elastic sheet 12 is made of elastic material, such as rubber or elastomer, and has operating section 12A, base section 12B situated on upper surface 3A of wiring board 3, and elastic thin portion 12C that couples operating section 12A to base section 12B. Movable contact 15 made of conductive material, such as carbon, is provided on lower surface 12D of operating section 12A. Movable contact 15 faces fixed contacts 4A and 4B. When operating section 12A protruding from hole 11A is depressed, elastic thin portion 12C elastically deforms and causes movable contact 15 to contact fixed contacts 4A and 4B. Thus, fixed contacts 4A and 4B are connected electrically with each other, thereby activating the switch contacts. Cutouts 11C formed in guide wall 11B of case 11 provide remote controller 1002 with similar effects as those of remote controller 1001.

Exemplary Embodiment 2

Figure 4:
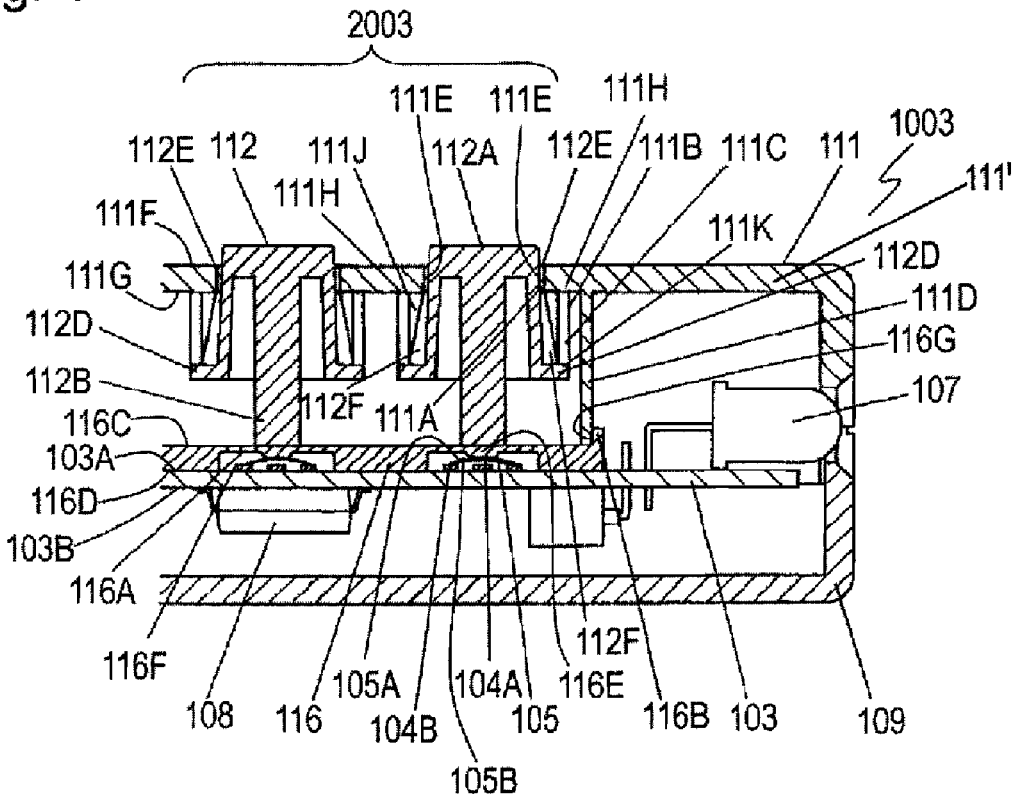
FIG. 4 is a sectional view of a remote controller in accordance with Exemplary Embodiment 2 of the invention.
Figure 5:
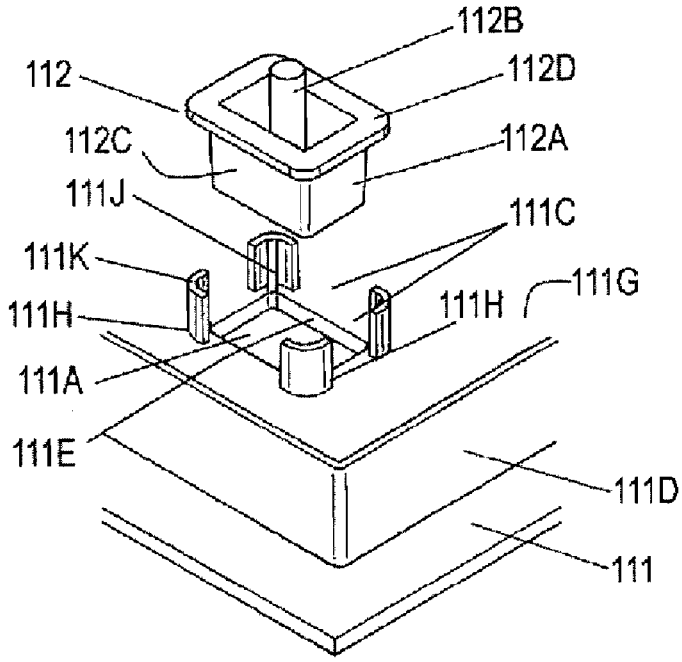
FIG. 5 is an exploded perspective view of an essential part of the remote controller shown in FIG. 4.

FIGS. 4 and 5 are a sectional view and an exploded perspective view of an essential part of remote controller 1003 in accordance with Exemplary Embodiment 2 of the present invention. Case 111 has a box shape and is made of insulating resin, such as ABS resin or polystyrene. Operating unit 112 is made of insulating resin. Case 111 has case wall 111' with upper surface 111F and lower surface 111G opposite to upper surface 111F. Holes 111A each having inner edge 111E are formed in upper surface 111F. Operating unit 112 is inserted into each hole 111A so as to be movable up and down, and includes operating section 112A protruding from upper surface 111F. Side surface 112C of operating unit 112 faces inner edge 111E of hole 111A.

Guide wall 111B having a substantially squared tubular shape protrudes from a position 111H of lower surface 111G of case 111 spaced apart from inner edge 111E of hole 111A. Guide wall 111B is spaced from side surface 112C of operating unit 112 via gap 112F. Operating unit 112 includes depressing section 112B protruding downward in case 111. Cutouts 111C are formed in four surfaces of guide wall 111B. Case 111 includes slope portion 111J which extends from inner edge 111E of hole 111A to lower ends 111K of guide wall 111B, that is, which extends downward and toward guide wall 111B. Slope portion 111J faces side surface 112C of operating unit 112. Operating unit 112 includes flange 112D protruding outward from side surface 112C. An upper surface of flange 112D contacts lower end 111K of guide wall 111B.

Wiring board 103 is made of insulating material, such as paper phenol or glass epoxy, and has upper surface 103A and lower surface 103B opposite to upper surface 103A. Wiring patterns made of conductive material, such as copper foil, are formed on upper surface 103A and lower surface 103B. Fixed contacts 104A and 104B made of conductive material, such as copper foil or carbon, are provided on upper surface 103A.

Movable contact 105 has a dome shape having convex surface 105A and concave surface 105B opposite to the convex surface. Movable contact 105 is made of conductive metal plate, such as copper alloy. An outer periphery of movable contact 105 is situated on fixed contact 104A. Concave surface 105B of movable contact 105 faces fixed contact 104A across a predetermined gap, thus providing plural switch contacts.

Elastic sheet 116 made of elastic insulating material, such as rubber or elastomer, is situated on upper surface 103A of wiring board 103. Elastic sheet 116 has upper surface 116C and lower surface 116D opposite to upper surface 116C. Lower surface 116D is situated on upper surface 103A of wiring board 103. Recess 116F is formed in lower surface 116D and accommodates movable contact 105 therein. Elastic sheet 116 includes thin portion 116A provided at a bottom of recess 116F, projection 116E protruding downward from thin portion 116A toward movable contact 105, and rib 116B provided at an outer periphery of sheet 116. Case 111 includes water-sealing wall 111D protruding downward from lower surface 111G. Water-sealing wall 111D elastically contacts inner wall 116G of rib 116B, thus providing switch 2003.

Transmitting section 107 and control section 108 are provided on upper surface 103A and lower surface 103B of wiring board 103. Transmitting section 107 includes an electronic component, such as a light emitting diode, for transmitting a remote controlling signal. Control section 108 includes a semiconductor device, such as a microprocessor, and is coupled to transmitting section 107 and fixed contacts 104A and 104B via the wiring patterns.

Cover 109 which has a box shape and which is made of insulating resin covers a lower surface of case 111 accommodating operating unit 112 and wiring board 103 therein. Cover 109 is fixed to case 111 with fixing members, such as screws, thus providing remote controller 1003.

An operation of remote controller 1003 will be described below. Remote controller 1003 is directed toward an electronic apparatus, such as a television receiver or a radio receiver, and operating section 102A of operating unit 102 is configured to be depressed. Upon being depressed, depressing section 102B depresses movable contact 105 via thin portion section 116A of elastic sheet 116. This causes movable contact 105 to elastically deform and turn inside out, allows convex surface 105B to contact fixed contact 104A, and then, connects fixed contact 104A electrically with fixed contact 104B, thus activating the switch contacts. Upon the switch contacts being activated, that is, upon fixed contacts 104A and 104B being connected electrically with each other, control section 108 allows transmitting section 107 to transmit an infrared remote controlling signal to the electronic apparatus in order to remotely control the electronic apparatus, for example, to turn on and off the apparatus, to select a channel, and to increase and decrease sound volume.

Inner edge 111E of hole 111A faces side surface 112C of operating unit 112 across small gap 112E, and flange 112D protruding from side surface 112C contacts lower end 111K of guide wall 111B. This structure allows operating unit 112 to be depressed while preventing operating unit 2 from slanting and wobbling. That is, operating unit 112 is guided along small gap 112E between operating unit 112 and inner edge 111E and a small gap between flange 112D and lower end 111K, thereby moving up and down in hole 111A while being prevented from slanting and wobbling.

Guide wall 111B protrudes from position 111H spaced apart from inner edge 111E of hole 111A, and allows gap 112F between side surface 112C of operating unit 112 and guide wall 111B to be larger than gap 112E. Even if liquid or water, such as coffee or juice, is spilled onto upper surface 111F of case 111 and flows into hole 111A, operating unit 112 is depressed reliably with a good feeling. That is, large gap 112F provided between side surface 112C and guide wall 111B causes the liquid flowing into hole 111A to be attached onto side surface 112C or guide wall 111B. Hence, the attached liquid does not prevent operating unit 112 from moving up and down. Thus, switch 2003 allows operating unit 112 to be activated reliably with a good operational feel, and allows the switch contacts to be activated reliably.

Cutouts 111C are formed in four surfaces of guide wall 111B. Even if the liquid flows into hole 111A, the liquid immediately flows out from cutouts 111C into a space between sheet 116 and lower surface 111G of case 111, thus being prevented from remaining and clotting in gap 112F. Therefore, switch 2003 is activated easily and reliably without losing a good operational feel, thus activating the switch contacts reliably.

Case 111 includes slope portion 111J extending downward from inner edge 111E of hole 111A toward guide wall 111B. When operating unit 112 is depressed with a large force, operating unit 112 may be located below lower surface 111G and sink in case 111. Even in this case, upon being released from the depression, side surface 112C of operating unit 112 contacts slope portion 111J and slides on slope portion 111J, thereby allowing operating section 112A to return from hole 111A to above upper surface 111F of case 111. Thus, in switch 2003, operating unit 112 cannot sink in case 111 and is activated reliably.

Elastic sheet 116 covers upper surface 103A of wiring board 103. Water-sealing wall 111D protruding downward from lower surface 111G of case 111 elastically contacts inner wall 116G of rib 116B provided at an outer periphery of sheet 116, thus providing a waterproof structure. This prevents the liquid flowing through cutout 111C from reaching wiring board 103, fixed contacts 104A and 104B, and movable contact 105, thereby allowing the switch contacts to be activated reliably.

Remote controller 1003 including switch 2003 in accordance with Embodiment 2 may include another movable contact instead of movable contact 105. This movable contact is provided on the lower surface of thin portion 116A of elastic sheet 116, is made of conductive material, such as carbon, and faces fixed contacts 104A and 104B. This movable contact provides plural switch contacts activated such that, upon operating section 112B being depressed, this movable contact contacts fixed contacts 104A and 104B, thus providing the same effects.

Figure 6:
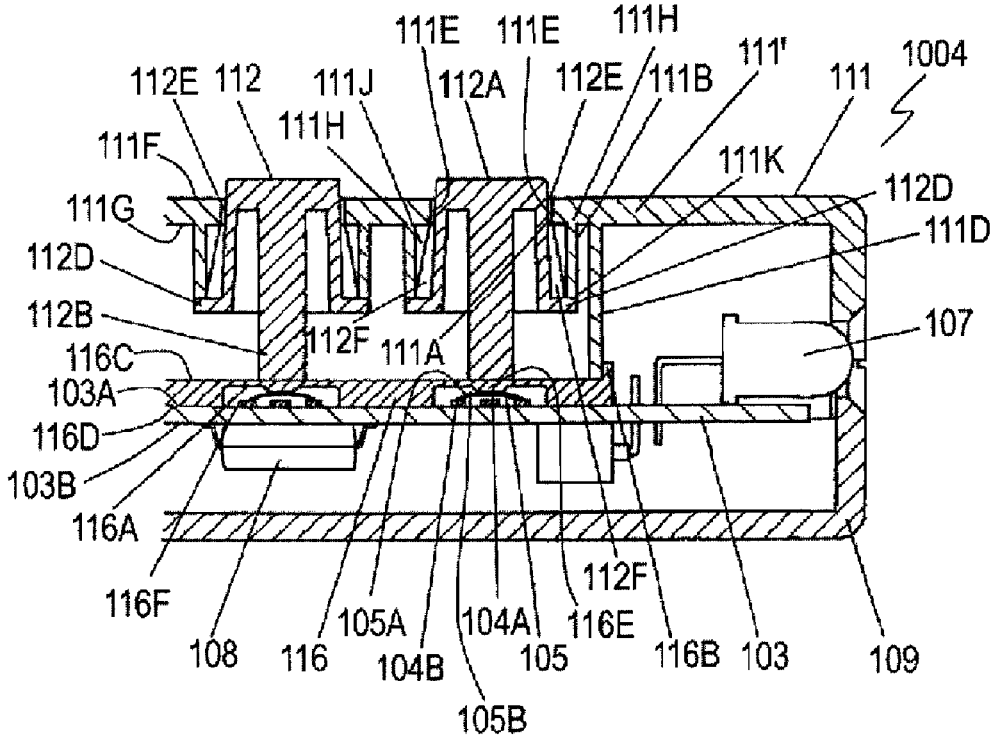
FIG. 6 is a sectional view of another remote controller in accordance with Embodiment 2.
Figure 7:
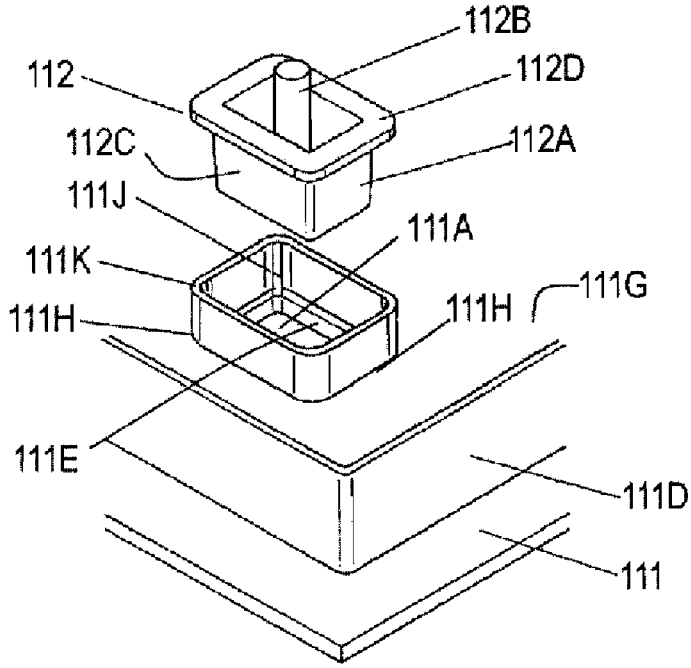
FIG. 7 is an exploded perspective view of an essential part of the remote controller shown in FIG. 6.

FIGS. 6 and 7 are a sectional view and an exploded perspective view of an essential part of another remote controller 1004 in accordance with Embodiment 2 of the present invention. In FIGS. 6 and 7, components identical to those of remote controller 1003 shown in FIGS. 4 and 5 are denoted by the same reference numerals, and their description will be omitted. Cutouts 111C are not formed in guide wall 111B of case 111 of remote controller 1004, and guide wall 111B surrounds both of operating unit 112 and hole 111A.

Inner edge 111E of hole 111A faces side surface 112C of operating unit 112 across small gap 112E. Flange 112D protruding from side surface 112C contacts lower end 111K of guide wall 111B. This structure allows operating unit 112 to be depressed while preventing operating unit 112 from slanting and wobbling. That is, operating unit 112 is guided along small gap 112E between operating unit 112 and inner edge 111E and a small gap between flange 112D and lower end 111K, and moves up and down in hole 111A while being prevented from slanting and wobbling.

Guide wall 11B protrudes from position 111H distanced from inner edge 111E of hole 111A, and allows gap 111F between side surface 112C of operating unit 112 and guide wall 111B to be larger than gap 112E. Even if liquid or water, such as coffee or juice, is spilled onto upper surface 111F of case 111 and flows into hole 111A, operating unit 112 is depressed reliably with a good operational feel. That is, large gap 112F provided between side surface 112C and guide wall 111B causes the liquid flowing into hole 111A to be attached onto side surface 112C or guide wall 111B. Hence, the attached liquid does not prevent operating unit 112 from moving up and down. Thus, switch 2003 allows operating unit 112 to be activated reliably with a good operational feel, and allows the switch contacts to be activated reliably.

What is claimed is:

1. A switch comprising:

a case having a case wall with oppositely facing upper and lower surfaces, said case wall having a hole provided therein through said upper and lower surfaces, said hole having an inner edge;

an operating unit movably disposed in said hole to be movable up and down, said operating unit having a side surface facing said inner edge of said hole;

a plurality of switch contacts configured to be operated upon movement of said operating unit up and down in said hole; and a guide wall protruding downward from said inner edge of said hole, said guide wall facing said side surface of said operating unit, wherein said guide wall has a cutout provided therein, said cutout reaching said lower surface of said case wall, wherein said guide wall has a base end connected to said lower surface of said case wall, and a distal end disposed below said base end, and wherein said cutout reaches from said base end to said distal end of said guide wall.

2. A remote controller comprising:

said switch as defined in claim 1; and a transmitting section for transmitting a remote controlling signal upon said plurality of switch contacts of said switch being operated.

3. The switch of claim 1, wherein said cutout is one of a plurality of cutouts provided in said guide wall and spaced apart from one another.

4. The switch of claim 3, wherein each of said cutouts reaches said lower surface of said case wall.

5. The switch of claim 3, wherein said guide wall has a base end connected to said lower surface of said case wall, and a distal end disposed below said base end; and each of said cutouts reaches from said base end to said distal end of said guide wall.

6. A switch comprising:

a case having a case wall having a hole provided therein, said hole having an inner edge;

an operating unit movably disposed in said hole to be movable up and down, said operating unit having a side surface facing said inner edge of said hole;

a plurality of switch contacts configured to be operated upon movement of said operating unit up and down in said hole;

a guide wall protruding downward from a position on said case wall spaced away from said inner edge of said hole, said guide wall facing said side surface of said operating unit, said guide wall having a substantially tubular shape; and a slope portion extending downward from said inner edge of said hole toward said guide wall, said slope portion facing said side surface of said operating unit, wherein said operating unit includes a flange protruding from said side surface, and wherein said guide wall has a lower end arranged to contact said flange.

7. The switch of claim 6, wherein said guide wall has a cutout provided therein.

8. The switch of claim 7, wherein said case wall has oppositely facing upper and lower surfaces, and said hole is provided in said case wall through said upper and lower surfaces; and said cutout reaches said lower surface of said case wall.

9. A remote controller comprising:

said switch as defined in claim 6; and a transmitting section for transmitting a remote controlling signal upon said plurality of switch contacts of said switch being operated.

10. The switch of claim 6, wherein said flange protrudes from said side surface of said operating unit in a direction generally parallel to said lower surface of said case wall such that an upper surface of said flange faces said lower surface of said case wall.

11. The switch of claim 10, wherein said lower end of said side wall is arranged to contact said upper surface of said flange.

12. A switch comprising:

a case having a case wall with oppositely facing upper and lower surfaces, said case wall having a hole provided therein through said upper and lower surfaces, said hole having an inner edge;

an operating unit movably disposed in said hole to be movable up and down, the operating unit having a side surface facing said inner edge of said hole;

a plurality of switch contacts configured to be operated upon movement of said operating unit up and down in said hole; and a guide wall protruding downward from said inner edge of said hole, said guide wall facing the side surface of said operating unit, wherein said guide wall has a cutout provided therein, said cutout reaching said lower surface of said case wall, and wherein said cutout is one of a plurality of cutouts provided in said guide wall and spaced apart from one another.

13. A remote controller comprising:

the switch as defined in claim 12; and a transmitting section for transmitting a remote controlling signal upon said plurality of switch contacts of said switch being operated.

14. The switch of claim 12, wherein each of said cutouts reaches said lower surface of said case wall.

15. The switch of claim 12, wherein said guide wall has a base end connected to said lower surface of said case wall, and a distal end disposed below said base end; and each of said cutouts reaches from said base end to said distal end of said guide wall.

* * * * *